US009424833B2

(12) United States Patent
Meyer et al.

(10) Patent No.: US 9,424,833 B2
(45) Date of Patent: Aug. 23, 2016

(54) METHOD AND APPARATUS FOR PROVIDING SPEECH OUTPUT FOR SPEECH-ENABLED APPLICATIONS

(71) Applicant: Nuance Communications, Inc., Burlington, MA (US)

(72) Inventors: Darren C. Meyer, Duxbury, MA (US); Corinne Bos-Plachez, Baisieux (FR); Martine Marguerite Staessen, Wervik (BE)

(73) Assignee: Nuance Communications, Inc., Burlington, MA (US)

( * ) Notice: Subject to any disclaimer, the term of this patent is extended or adjusted under 35 U.S.C. 154(b) by 0 days.

(21) Appl. No.: 14/572,451

(22) Filed: Dec. 16, 2014

(65) Prior Publication Data

US 2015/0106101 A1 Apr. 16, 2015

Related U.S. Application Data

(63) Continuation of application No. 12/704,859, filed on Feb. 12, 2010, now Pat. No. 8,949,128.

(51) Int. Cl.

| | |
|---|---|
| ***G10L 13/02*** | (2013.01) |
| ***G10L 13/04*** | (2013.01) |
| *G10L 13/08* | (2013.01) |

(52) U.S. Cl.

CPC ..... *G10L 13/02* (2013.01); *G10L 13/04* (2013.01); *G10L 13/08* (2013.01)

(58) Field of Classification Search

CPC ..... G10L 13/04; G10L 13/07; G10L 13/00; G10L 13/06; G10L 13/10; G10L 15/1807

USPC ..... 704/260, 270.1, 275, 271, 270, 258, 704/234, 235, 209; 434/236, 178; 379/88.16

See application file for complete search history.

(56) References Cited

U.S. PATENT DOCUMENTS

| | | | | |
|---|---|---|---|---|
| 5,652,828 | A | 7/1997 | Silverman | |
| 5,668,926 | A | 9/1997 | Karaali et al. | |
| 5,860,064 | A | 1/1999 | Henton | |
| 6,035,271 | A | 3/2000 | Chen | |
| 6,058,366 | A * | 5/2000 | Tarkiainen | G06F 8/38 704/270 |
| 6,081,780 | A | 6/2000 | Lumelsky | |
| 6,101,470 | A | 8/2000 | Eide et al. | |

(Continued)

OTHER PUBLICATIONS

Forney, "The Viterbi Algorithm" Proc. IEEE, v. 61, pp. 268-278, 1973.

(Continued)

*Primary Examiner* — Michael Colucci

(74) *Attorney, Agent, or Firm* — Wolf, Greenfield & Sacks, P.C.

(57) ABSTRACT

Techniques for providing speech output for speech-enabled applications. A synthesis system receives from a speech-enabled application a text input including a text transcription of a desired speech output. The synthesis system selects one or more audio recordings corresponding to one or more portions of the text input. In one aspect, the synthesis system selects from audio recordings provided by a developer of the speech-enabled application. In another aspect, the synthesis system selects an audio recording of a speaker speaking a plurality of words. The synthesis system forms a speech output including the one or more selected audio recordings and provides the speech output for the speech-enabled application.

10 Claims, 6 Drawing Sheets

(56) References Cited

U.S. PATENT DOCUMENTS 6,173,266 B1 * 1/2001 Marx ..... G10L 15/22 704/270
6,266,637 B1 7/2001 Donovan et al.
6,345,250 B1 2/2002 Martin
6,389,396 B1 * 5/2002 Lyberg ..... G06T 13/205 704/258
6,446,040 B1 9/2002 Socher et al.
6,665,641 B1 * 12/2003 Coorman ..... G10L 13/07 704/258
6,738,457 B1 * 5/2004 Pickering ..... G10L 13/033 379/88.16
6,810,378 B2 10/2004 Kochanski et al.
6,865,533 B2 3/2005 Addison et al.
7,143,042 B1 * 11/2006 Sinai ..... G10L 15/22 704/270.1
7,203,648 B1 * 4/2007 Ostermann ..... G09B 21/009 704/260
7,269,557 B1 * 9/2007 Bailey ..... G10L 13/07 704/251
7,328,157 B1 * 2/2008 Chu ..... G10L 13/08 704/258
7,401,020 B2 7/2008 Eide
7,455,522 B2 * 11/2008 Polanyi ..... G09B 5/02 434/178
7,519,531 B2 * 4/2009 Acero ..... G10L 15/07 704/209
7,565,292 B2 * 7/2009 Deng ..... G10L 13/02 704/260
7,643,998 B2 * 1/2010 Yuen ..... H04M 3/4938 704/270
7,693,716 B1 * 4/2010 Davis ..... G10L 13/04 704/258
7,809,578 B2 * 10/2010 Vitikainen ..... G10L 15/30 379/88.01
7,899,672 B2 3/2011 Qin et al.
8,126,716 B2 * 2/2012 Dhanakshirur ... H04M 3/42144 704/258
8,447,610 B2 5/2013 Meyer et al.
8,571,870 B2 10/2013 Meyer et al.
8,666,746 B2 * 3/2014 Bangalore ..... G10L 13/06 704/258
8,682,671 B2 3/2014 Meyer et al.
8,825,486 B2 9/2014 Meyer et al.
8,886,538 B2 11/2014 Aaron et al.
8,914,291 B2 12/2014 Meyer et al.
2002/0072908 A1 * 6/2002 Case ..... G10L 13/07 704/260
2002/0133348 A1 9/2002 Pearson et al.
2003/0158734 A1 * 8/2003 Cruickshank ..... G10L 13/07 704/260
2004/0013887 A1 1/2004 Hichri et al.
2004/0030555 A1 * 2/2004 van Santen ..... G10L 13/08 704/260
2004/0049391 A1 * 3/2004 Polanyi ..... G10L 15/1807 704/271
2004/0193398 A1 * 9/2004 Chu ..... G10L 13/08 704/3
2004/0197750 A1 * 10/2004 Donaher ..... G09B 7/00 434/236
2005/0027523 A1 * 2/2005 Tarlton ..... G10L 15/22 704/234
2005/0071163 A1 3/2005 Aaron et al.
2005/0096909 A1 * 5/2005 Bakis ..... G10L 13/027 704/260
2005/0125232 A1 * 6/2005 Gadd ..... G10L 15/26 704/270.1
2006/0259303 A1 * 11/2006 Bakis ..... G10L 13/10 704/268
2007/0033049 A1 2/2007 Qin et al.
2007/0043568 A1 2/2007 Dhanakshirur et al.
2007/0192105 A1 8/2007 Neeracher et al.
2008/0288256 A1 * 11/2008 Agapi ..... G10L 13/04 704/260
2009/0048843 A1 * 2/2009 Nitisaroj ..... G10L 15/1807 704/260
2010/0100377 A1 * 4/2010 Madhavapeddi ..... G10L 15/22 704/235
2010/0312564 A1 * 12/2010 Plumpe ..... G10L 13/033 704/260
2011/0054903 A1 * 3/2011 Yan ..... G10L 13/08 704/260
2011/0202345 A1 8/2011 Meyer et al.
2011/0202346 A1 8/2011 Meyer et al.
2012/0130718 A1 5/2012 Dhanakshirur et al.

OTHER PUBLICATIONS

Natural Playback Modules (NPM), Nuance Professional Services.
Saon et al., "Maximum Likelihood Discriminant Feature Spaces," 2000, IEEE International Conference on Acoustics, Speech, and Signal Processing, vol. 2, Jun. 5-9, 2000, pp. 1129-1132.

* cited by examiner

METHOD AND APPARATUS FOR PROVIDING SPEECH OUTPUT FOR SPEECH-ENABLED APPLICATIONS

CROSS REFERENCE TO RELATED APPLICATIONS

This application is a continuation of U.S. patent application Ser. No. 12/704,859, entitled "Method and Apparatus for Providing Speech Output for Speech-Enabled Applications" and filed on Feb. 12, 2010, which is incorporated herein by reference in its entirely.

BACKGROUND OF INVENTION

1. Field of Invention

The techniques described herein are directed generally to the field of speech synthesis, and more particularly to techniques for providing speech output for speech-enabled applications.

2. Description of the Related Art

Speech-enabled software applications exist that are capable of providing output to a human user in the form of speech. For example, in an interactive voice response (IVR) application, a user typically interacts with the software application using speech as a mode of both input and output. Speech-enabled applications are used in many different contexts, such as telephone call centers for airline flight information, banking information and the like, global positioning system (GPS) devices for driving directions, e-mail, text messaging and web browsing applications, handheld device command and control, and many others. When a user communicates with a speech-enabled application by speaking, automatic speech recognition is typically used to determine the content of the user's utterance and map it to an appropriate action to be taken by the speech-enabled application. This action may include outputting to the user an appropriate response, which is rendered as audio speech output through some form of speech synthesis (i.e., machine rendering of speech). Speech-enabled applications may also be programmed to output speech prompts to deliver information or instructions to the user, whether in response to a user input or to other triggering events recognized by the running application.

Techniques for synthesizing output speech prompts to be played to a user as part of an IVR dialog or other speech-enabled application have conventionally been of two general forms: concatenated prompt recording and text to speech synthesis. Concatenated prompt recording (CPR) techniques require a developer of the speech-enabled application to specify the set of speech prompts that the application will be capable of outputting, and to code these prompts into the application. Typically, a voice talent (i.e., a particular human speaker) is engaged during development of the speech-enabled application to speak various word sequences or phrases that will be used in the output speech prompts of the running application. These spoken word sequences are recorded and stored as audio recording files, each referenced by a particular filename. When specifying an output speech prompt to be used by the speech-enabled application, the developer designates a particular sequence of audio prompt recording files to be concatenated (e.g., played consecutively) to form the speech output.

FIG. 1A illustrates steps involved in a conventional CPR process to synthesize an example desired speech output 110. In this example, the desired speech output 110 is, "Arriving at 221 Baker St. Please enjoy your visit." Desired speech output 110 could represent, for example, an output prompt to be played to a user of a GPS device upon arrival at a destination with address 221 Baker St. To specify that such an output prompt should be synthesized through CPR in response to the detection of such a triggering event by the speech-enabled application, a developer would enter the output prompt into the application software code. An example of the substance of such code is given in FIG. 1A as example input code 120.

Input code 120 illustrates example pieces of code that a developer of a speech-enabled application would enter to instruct the application to form desired speech output 110 through conventional CPR techniques. Through input code 120, the developer directly specifies which pre-recorded audio files should be used to render each portion of desired speech output 110. In this example, the beginning portion of the speech output, "Arriving at", corresponds to an audio file named "i.arrive.wav", which contains pre-recorded audio of a voice talent speaking the word sequence "Arriving at" at the beginning of a sentence. Similarly, an audio file named "m.address.hundreds2.wav" contains pre-recorded audio of the voice talent speaking the number "two" in a manner appropriate for the hundreds digit of an address in the middle of a sentence, and an audio file named "m.address.units21.wav" contains pre-recorded audio of the voice talent speaking "twenty-one" in a manner appropriate for the units of an address in the middle of a sentence. These audio files are selected and ordered as a sequence of audio segments 130, which are ultimately concatenated to form the speech output of the speech-enabled application. To specify that these particular audio files be selected for the various portions of the desired speech output 110, the developer of the speech-enabled application enters their filenames (i.e., "i.arrive.wav", "m.address.hundreds2.wav", etc.) into input code 120 in the proper sequence.

For some specific types of desired speech output portions (generally conveying numeric information), such as the address number "221" in desired speech output 110, an application using conventional CPR techniques can also issue a call-out to a separate library of function calls for mapping those specific word types to audio recording filenames. For example, for the "221" portion of desired speech output 110, input code 120 could contain code that calls the name of a specific function for mapping address numbers in English to sequences of audio filenames and passes the number "221" to that function as input. Such a function would then apply a hard coded set of language-specific rules for address numbers in English, such as a rule indicating that the hundreds place of an address in English maps to a filename in the form of "m.address.hundreds_.wav" and a rule indicating that the tens and units places of an address in English map to a filename in the form of "m.address.units_.wav". To make use of such function calls, a developer of a speech-enabled application would be required to supply audio recordings of the specific words in the specific contexts referenced by the function calls, and to name those audio recording files using the specific filename formats referenced by the function calls.

In the example of FIG. 1A, the "Baker" portion of desired speech output 110 does not correspond to any available audio recordings pre-recorded by the voice talent. For example, in many instances it can be impractical to engage the voice talent to pre-record speech audio for every possible street name that a GPS application may eventually need to include in an output speech prompt. For such desired speech output portions that do not match any pre-recorded audio, speech-enabled applications relying primarily on CPR techniques are typically programmed to issue call-outs (in a program code form similar to that described above for calling out to a function library) to a separate text to speech (TTS) synthesis engine, as represented in portion 122 of example input code 120. The TTS engine then renders that portion of the desired speech output as a sequence of separate subword units such as phonemes, as represented in portion 132 of the example sequence of audio segments 130, rather than a single audio recording as produced naturally by a voice talent.

Text to speech (TTS) synthesis techniques allow any desired speech output to be synthesized from a text transcription (i.e., a spelling out, or orthography, of the sequence of words) of the desired speech output. Thus, a developer of a speech-enabled application need only specify plain text transcriptions of output speech prompts to be used by the application, if they are to be synthesized by TTS. The application may then be programmed to access a separate TTS engine to synthesize the speech output. Conventional TTS engines most commonly produce output audio using concatenative text to speech synthesis, whereby the input text transcription of the desired speech output is analyzed and mapped to a sequence of subword units such as phonemes. The concatenative TTS engine typically has access to a database of small audio files, each audio file containing a single subword unit (e.g., a phoneme or a portion of a phoneme) excised from many hours of speech pre-recorded by a voice talent. Complex statistical models are applied to select preferred subword units from this large database to be concatenated to form the particular sequence of subword units of the speech output.

Other techniques for TTS synthesis exist that do not involve recording any speech from a voice talent. Such TTS synthesis techniques include formant synthesis and articulatory synthesis, among others. In formant synthesis, an artificial sound waveform is generated and shaped to model the acoustics of human speech. A signal with a harmonic spectrum, similar to that produced by human vocal folds, is generated and filtered using resonator models to impose spectral peaks, known as formants, on the harmonic spectrum. Parameters such as periodic voicing, fundamental frequency, turbulence noise levels, formant frequencies and bandwidths, spectral tilt and the like are varied over time to generate the sound waveform emulating a sequence of speech sounds. In articulatory synthesis, an artificial glottal source signal, similar to that produced by human vocal folds, is filtered using computational models of the human vocal tract and of the articulatory processes that change the shape of the vocal tract to make speech sounds. Each of these TTS synthesis techniques typically involves representing the input text as a sequence of phonemes, and applying complex models (acoustic and/or articulatory) to generate output sound for each phoneme in its specific context within the sequence.

In addition to sometimes being used to fill in small gaps in CPR speech output, as illustrated in FIG. 1A, TTS synthesis is sometimes used to implement a system for synthesizing speech output that does not employ CPR at all, but rather uses only TTS to synthesize entire speech output prompts, as illustrated in FIG. 1B. FIG. 1B illustrates steps involved in conventional full concatenative TTS synthesis of the same desired speech output 110 that was synthesized using CPR techniques in FIG. 1A. In the TTS example of FIG. 1B, a developer of a speech-enabled application specifies the output prompt by programming the application to submit plain text input to a TTS engine. The example text input 150 is a plain text transcription of desired speech output 110, submitted to the TTS engine as, "Arriving at 221 Baker St. Please enjoy your visit." The TTS engine typically applies language models to determine a sequence of phonemes corresponding to the text input, such as phoneme sequence 160. The TTS engine then applies further statistical models to select small audio files from a database, each small audio file corresponding to one of the phonemes (or a portion of a phoneme, such as a demiphone, or half-phone) in the sequence, and concatenates the resulting sequence of audio segments 170 in the proper sequence to form the speech output. The database typically contains a large number of phoneme audio files excised from long recordings of the speech of a voice talent. Each phoneme is typically represented by multiple audio files excised from different times the phoneme was uttered by the voice talent in different contexts (e.g., the phoneme /t/ could be represented by an audio file excised from the beginning of a particular utterance of the word "tall", an audio file excised from the middle of an utterance of the word "battle", an audio file excised from the end of an utterance of the word "pat", two audio files excised from an utterance of the word "stutter", and many others). Statistical models are used by the TTS engine to select the best match from the multiple audio files for each phoneme given the context of the particular phoneme sequence to be synthesized. The long recordings from which the phoneme audio files in the database are excised are typically made with the voice talent reading a generic script, unrelated to any particular speech-enabled application in which the TTS engine will eventually be employed.

SUMMARY OF INVENTION

One embodiment is directed to a method for providing a speech output for a speech-enabled application, the method comprising receiving from the speech-enabled application a text input comprising a text transcription of a desired speech output; selecting, using at least one computer system, at least one audio recording provided by a developer of the speech-enabled application, the at least one audio recording corresponding to at least a first portion of the text input; and providing for the speech-enabled application a speech output comprising the at least one audio recording.

Another embodiment is directed to a system for providing a speech output for a speech-enabled application, the system comprising at least one processor configured to receive from the speech-enabled application a text input comprising a text transcription of a desired speech output; select at least one audio recording provided by a developer of the speech-enabled application, the at least one audio recording corresponding to at least a first portion of the text input; and provide for the speech-enabled application a speech output comprising the at least one audio recording.

Another embodiment is directed to at least one non-transitory computer-readable storage medium encoded with a plurality of computer-executable instructions that, when executed, perform a method for providing a speech output for a speech-enabled application, the method comprising receiving from the speech-enabled application a text input comprising a text transcription of a desired speech output; selecting at least one audio recording provided by a developer of the speech-enabled application, the at least one audio recording corresponding to at least a first portion of the text input; and providing for the speech-enabled application a speech output comprising the at least one audio recording.

Another embodiment is directed to a method for creating a speech output for a speech-enabled application, the method comprising generating, by the speech-enabled application, a text input comprising a text transcription of a desired speech output; and providing, by a developer of the speech-enabled application, at least one audio recording corresponding to at least a first portion of the text input.

Another embodiment is directed to a method for providing a speech output for a speech-enabled application, the method comprising receiving from the speech-enabled application a text input comprising a text transcription of a desired speech output; selecting, using at least one computer system, an audio recording of a speaker speaking a plurality of words, the audio recording corresponding to at least a first portion of the text input; and providing for the speech-enabled application a speech output comprising the audio recording.

Another embodiment is directed to a system for providing a speech output for a speech-enabled application, the system comprising at least one processor configured to receive from the speech-enabled application a text input comprising a text transcription of a desired speech output; select an audio recording of a speaker speaking a plurality of words, the audio recording corresponding to at least a first portion of the text input; and provide for the speech-enabled application a speech output comprising the audio recording.

Another embodiment is directed to at least one non-transitory computer-readable storage medium encoded with a plurality of computer-executable instructions that, when executed, perform a method for providing a speech output for a speech-enabled application, the method comprising receiving from the speech-enabled application a text input comprising a text transcription of a desired speech output; selecting an audio recording of a speaker speaking a plurality of words, the audio recording corresponding to at least a first portion of the text input; and providing for the speech-enabled application a speech output comprising the audio recording.

Another embodiment is directed to a method for providing a speech output for a speech-enabled application, the method comprising receiving at least one input specifying a desired speech output; selecting, using at least one computer system, at least one audio recording corresponding to at least a first portion of the desired speech output, the at least one audio recording being selected based at least in part on at least one constraint indicated by metadata associated with the at least one audio recording, the at least one constraint comprising at least one constraint regarding a desired contrastive stress pattern in the desired speech output; and providing for the speech-enabled application a speech output comprising the at least one audio recording.

Another embodiment is directed to a system for providing a speech output for a speech-enabled application, the system comprising at least one processor configured to receive at least one input specifying a desired speech output; select at least one audio recording corresponding to at least a first portion of the desired speech output, the at least one audio recording being selected based at least in part on at least one constraint indicated by metadata associated with the at least one audio recording, the at least one constraint comprising at least one constraint regarding a desired contrastive stress pattern in the desired speech output; and provide for the speech-enabled application a speech output comprising the at least one audio recording.

Another embodiment is directed to at least one non-transitory computer-readable storage medium encoded with a plurality of computer-executable instructions that, when executed, perform a method for providing a speech output for a speech-enabled application, the method comprising receiving at least one input specifying a desired speech output; selecting at least one audio recording corresponding to at least a first portion of the desired speech output, the at least one audio recording being selected based at least in part on at least one constraint indicated by metadata associated with the at least one audio recording, the at least one constraint comprising at least one constraint regarding a desired contrastive stress pattern in the desired speech output; and providing for the speech-enabled application a speech output comprising the at least one audio recording.

BRIEF DESCRIPTION OF DRAWINGS

The accompanying drawings are not intended to be drawn to scale. In the drawings, each identical or nearly identical component that is illustrated in multiple figures is represented by a like numeral. For purposes of clarity, not every component may be labeled in every drawing. In the drawings.

DETAILED DESCRIPTION

Figure 1A:
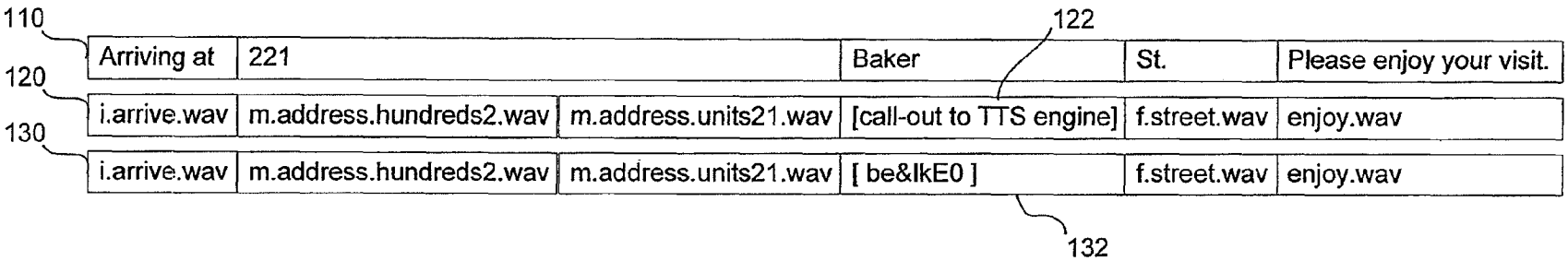
FIG. 1A (Prior Art)
FIG. 1A illustrates an example of conventional concatenated prompt recording (CPR) synthesis.

Applicants have recognized that conventional speech output synthesis techniques for speech-enabled applications suffer from various drawbacks. Conventional CPR techniques, as discussed above, require a developer of the speech-enabled application to hard code the desired output speech prompts with the filenames of the specific audio files of the prompt recordings that will be concatenated to form the speech output. This is a time consuming and labor intensive process requiring a skilled programmer of such systems. This also requires the speech-enabled application developer to decide, prior to programming the application's output speech prompts, which portions of each prompt will be pre-recorded by a voice talent and which will be synthesized through call-outs to a TTS engine. Conventional CPR techniques also require the application developer to remember or look up the appropriate filenames to code in each portion of the desired speech output that will be produced using a prompt recording. If the developer wishes to use a third-party library of function calls to map certain word sequences of specific constrained types to prompt recording filenames, the developer is restricted to pre-recording a specific set of prompt recordings mandated by the function library, as well as to naming the prompt recording files using a specific convention mandated by the function library. In addition, the resulting code (e.g., input code 120 in FIG. 1A) is not easy to read or to intuitively associate with the words of the speech output, which can lead to frustration and wasted time during programming, debugging and updating processes.

By contrast, conventional TTS techniques allow the speech-enabled application developer to specify desired output speech prompts using plain text transcriptions. This results in a relatively less time consuming programming process, which may require relatively less skill in programming. However, the state of the art in TTS synthesis technology typically produces speech output that is relatively monotone and flat, lacking the naturalness and emotional expressiveness of the naturally produced human speech that can be provided by a recording of a speaker speaking a prompt. Applicants have further recognized that the process of conventional TTS synthesis is typically not well understood by developers of speech-enabled applications, whose expertise is in designing dialogs for interactive voice response (IVR) applications (for example, delivering flight information or banking assistance) rather than in complex statistical models for mapping acoustical features to phonemes and phonemes to text, for example. In this respect, Applicants have recognized that the use of conventional TTS synthesis to create output speech prompts typically requires speech-enabled application developers to rely on third-party TTS engines for the entire process of converting text input to audio output, requiring that they relinquish control of the type and character of the speech output that is produced.

In accordance with some embodiments of the present invention, techniques are provided that enable the process of speech-enabled application design to be simple while providing naturalness of the speech output and developer control over the synthesis process. Applicants have appreciated that these benefits, which were to a certain extent mutually exclusive under conventional techniques, may be simultaneously achieved through methods and apparatus that accept as input plain text transcriptions of desired speech output, automatically select appropriate audio prompt recordings from a developer-supplied dataset, and concatenate the audio recordings to provide speech output for the speech-enabled application. In accordance with some embodiments of the present invention, the developer of the speech-enabled application may decide which portions of desired output speech prompts to pre-record as prompt recordings and to provide to the synthesis system, and may engage a desired voice talent to speak the prompt recordings in precisely the style the developer prefers. During user interaction with a speech-enabled application, the application may provide to the synthesis system an input text transcription of a desired speech output, and the synthesis system may analyze the text input to select appropriate audio recordings from those supplied by the speech-enabled application developer to include in the speech output that it provides for the application. In this manner, the naturalness of the prompt recordings as spoken by the voice talent may be retained, and the application developer may retain control over the audio that is recorded, while allowing the desired speech output prompts to be specified in plain text by the speech-enabled application.

In accordance with some embodiments of the present invention, some pre-recorded prompt recordings may be audio recordings of the voice talent speaker speaking multiple connected words to be played back together, such that the naturalness and expressiveness of the speaker recording the words together in any desired manner may be retained when the recording is played back. The developer of the speech-enabled application may, for example, decide to pre-record large portions of the desired output speech prompts that will commonly be produced with the same word sequence across different output prompts. In this manner, more natural speech output may be produced by including multiple-word speech portions in prompt recordings where appropriate and minimizing the number (if any) of concatenations needed to produce the speech output.

In accordance with some embodiments of the present invention, the developer of the speech-enabled application may provide the audio prompt recordings with associated metadata constraining their use in producing speech output. For example, an audio recording may have associated metadata indicating that that particular audio recording should only (or preferably) be used to produce speech output containing a certain type of word (e.g., a natural number, a date, an address, etc.), for example because the recording was made of the speaker speaking words in a context appropriate to the constrained scenario. In another example, an audio recording's metadata may indicate that it should only (or preferably) be used in a certain position with respect to a certain punctuation mark in an orthography of the desired speech output. In yet another example, metadata may constrain an audio recording to be used when the desired speech output is to have a certain contrastive stress, or emphasis, pattern. Metadata for some audio recordings may also indicate that those audio recordings can be used in any context with matching text, for example as a default for desired speech output portions for which no audio recordings with more restrictive metadata constraints are appropriate. Numerous other uses can be made of metadata constraints which may be associated with particular audio recordings or groups of audio recordings, as aspects of the invention that relate to the use of metadata constraints are not limited to any particular types of constraints.

In this manner, the speech-enabled application developer may maintain a further degree of control over the speech output that is produced for a given text input from the speech-enabled application. When a text input is received, the synthesis system may analyze the text input, along with any annotations provided by the speech-enabled application, and select appropriate audio recordings for concatenation in accordance with the metadata constraints. In some embodiments, the speech-enabled application developer may provide multiple pre-recorded audio recordings as different versions of speech output that can be represented by a same textual orthography. Metadata provided by the developer in association with the audio recordings may provide an indication of which version should be used in producing speech output in a certain context.

The aspects of the present invention described herein can be implemented in any of numerous ways, and are not limited to any particular implementation techniques. Thus, while examples of specific implementation techniques are described below, it should be appreciated that the examples are provided merely for purposes of illustration, and that other implementations are possible.

One illustrative application for the techniques described herein is for use in connection with an interactive voice response (IVR) application, for which speech may be a primary mode of input and output. However, it should be appreciated that aspects of the present invention described herein are not limited in this respect, and may be used with numerous other types of speech-enabled applications other than IVR applications. In this respect, while a speech-enabled application in accordance with embodiments of the present invention may be capable of providing output in the form of synthesized speech, it should be appreciated that a speech-enabled application may also accept and provide any other suitable forms of input and/or output, as aspects of the present invention are not limited in this respect. For instance, some examples of speech-enabled applications may accept user input through a manually controlled device such as a telephone keypad, keyboard, mouse, touch screen or stylus, and provide output to the user through speech. Other examples of speech-enabled applications may provide speech output in certain instances and other forms of output, such as visual output or non-speech audio output, in other instances. Examples of speech-enabled applications include, but are not limited to, automated call-center applications, internet-based applications, device-based applications, and any other suitable application that is speech enabled.

Figure 2:
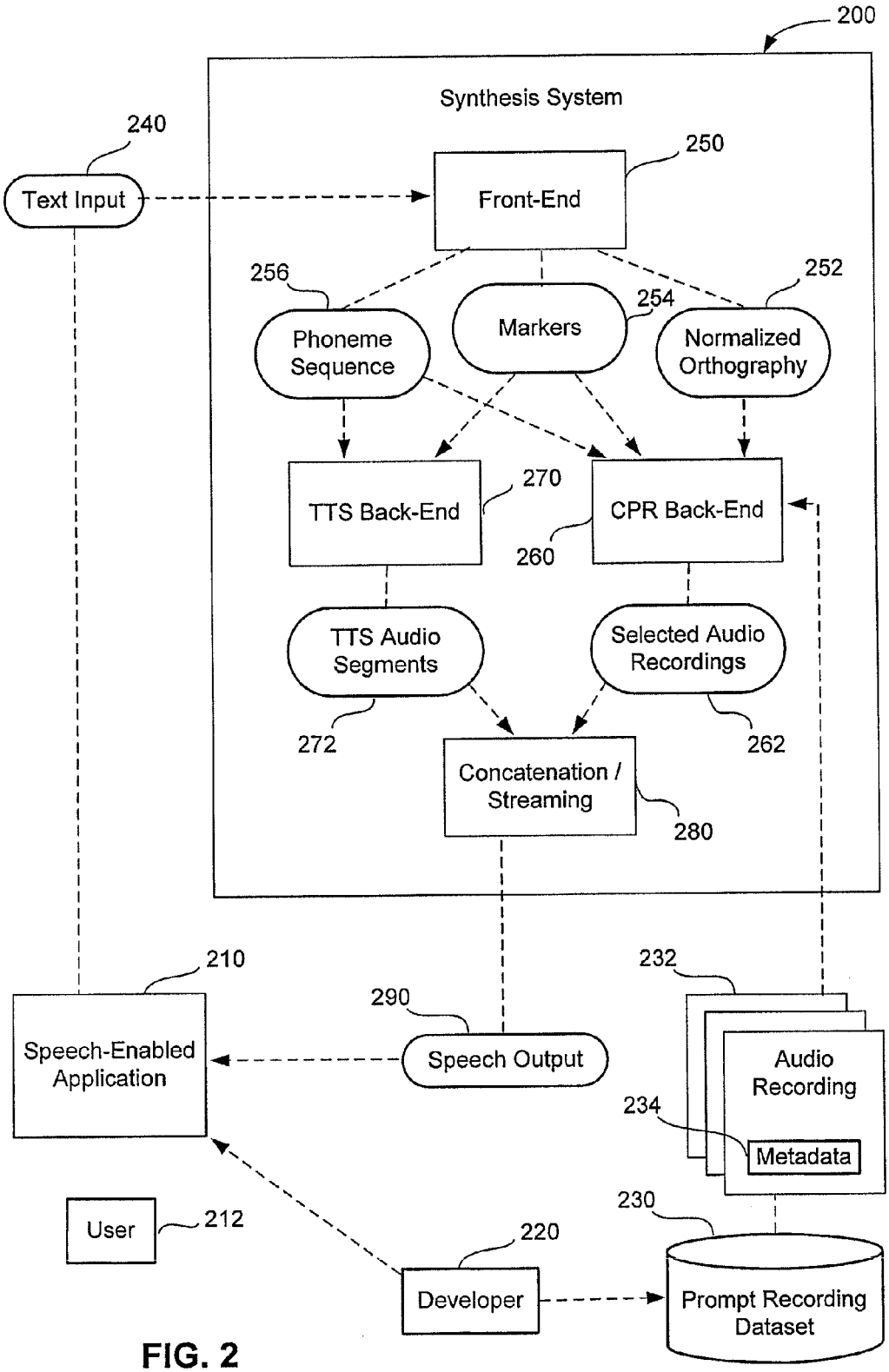
FIG. 2 is a block diagram of an exemplary system for providing speech output for a speech-enabled application, in accordance with some embodiments of the present invention.

An exemplary synthesis system 200 for providing speech output for a speech-enabled application 210 in accordance with some embodiments of the present invention is illustrated in FIG. 2. As discussed above, the speech-enabled application may be any suitable type of application capable of providing output to a user 212 in the form of speech. In accordance with some embodiments of the present invention, the speech-enabled application 210 may be an IVR application; however, it should be appreciated that aspects of the present invention are not limited in this respect.

Synthesis system 200 may receive data from and transmit data to speech-enabled application 210 by any suitable means, as aspects of the present invention are not limited in this respect. For example, in some embodiments, speech-enabled application 210 may access synthesis system 200 through one or more networks such as the Internet. Other suitable forms of network connections include, but are not limited to, local area networks, medium area networks and wide area networks. It should be appreciated that speech-enabled application 210 may communicate with synthesis system 200 through any suitable form of network connection, as aspects of the present invention are not limited in this respect. In other embodiments, speech-enabled application 210 may be directly connected to synthesis system 200 by any suitable communication medium (e.g., through circuitry or wiring), as aspects of the invention are not limited in this respect. It should be appreciated that speech-enabled application 210 and synthesis system 200 may be implemented together in an embedded fashion on the same device or set of devices, or may be implemented in a distributed fashion on separate devices or machines, as aspects of the present invention are not limited in this respect. Each of synthesis system 200 and speech-enabled application 210 may be implemented on one or more computer systems in hardware, software, or a combination of hardware and software, examples of which will be described in further detail below. It should also be appreciated that various components of synthesis system 200 may be implemented together in a single physical system or in a distributed fashion in any suitable combination of multiple physical systems, as aspects of the present invention are not limited in this respect. Similarly, although the block diagram of FIG. 2 illustrates various components in separate blocks, it should be appreciated that one or more components may be integrated in implementation with respect to physical components and/or software programming code.

Speech-enabled application 210 may be developed and programmed at least in part by a developer 220. It should be appreciated that developer 220 may represent a single individual or a collection of individuals, as aspects of the present invention are not limited in this respect. Developer 220 may supply a prompt recording dataset 230 that includes one or more audio recordings 232. Prompt recording dataset 230 may be implemented in any suitable fashion, including as one or more computer-readable storage media, as aspects of the present invention are not limited in this respect. Data, including audio recordings 232 and/or any metadata 234 associated with audio recordings 232, may be transmitted between prompt recording dataset 230 and synthesis system 200 in any suitable fashion through any suitable form of direct and/or network connection(s), examples of which were discussed above with reference to speech-enabled application 210.

Audio recordings 232 may include recordings of a voice talent (i.e., a human speaker) speaking the words and/or word sequences selected by developer 220 to be used as prompt recordings for providing speech output to speech-enabled application 210. As discussed above, each prompt recording may represent a speech sequence, which may take any suitable form, examples of which include a single word, a prosodic word, a sequence of multiple words, an entire phrase or prosodic phrase, or an entire sentence or sequence of sentences, that will be used in various output speech prompts according to the specific function(s) of speech-enabled application 210. Audio recordings 232, each representing one or more specified prompt recordings (or portions thereof) to be used by synthesis system 200 in providing speech output for speech-enabled application 210, may be pre-recorded during and/or in connection with development of speech-enabled application 210. In this manner, developer 220 may specify and control the content, form and character of audio recordings 232 through knowledge of their intended use in speech-enabled application 210. In this respect, in some embodiments, audio recordings 232 may be specific to speech-enabled application 210. In other embodiments, audio recordings 232 may be specific to a number of speech-enabled applications, or may be more general in nature, as aspects of the present invention are not limited in this respect. Developer 220 may also choose and/or specify filenames for audio recordings 232 in any suitable way according to any suitable criteria, as aspects of the present invention are not limited in this respect.

Audio recordings 232 may be pre-recorded and stored in prompt recording dataset 230 using any suitable technique, as aspects of the present invention are not limited in this respect. For example, audio recordings 232 may be made of the voice talent reading one or more scripts whose text corresponds exactly to the words and/or word sequences specified by developer 220 as prompt recordings for speech-enabled application 210. The recording of the word(s) spoken by the voice talent for each specified prompt recording (or portion thereof) may be stored in a single audio file in prompt recording dataset 230 as an audio recording 232. Audio recordings 232 may be stored as audio files using any suitable technique, as aspects of the present invention are not limited in this respect. An audio recording 232 representing a sequence of contiguous words to be used in speech output for speech-enabled application 210 may include an intact recording of the human voice talent speaker speaking the words consecutively and naturally in a single utterance. In some embodiments, the audio recording 232 may be processed using any suitable technique as desired for storage, reproduction, and/or any other considerations of speech-enabled application 210 and/or synthesis system 200 (e.g., to remove silent pauses and/or misspoken portions of utterances, to mitigate background noise interference, to manipulate volume levels, etc.), while maintaining the sequence of words desired for the prompt recording as spoken by the voice talent.

Developer 220 may also supply metadata 234 in association with one or more of the audio recordings 232. Metadata 234 may be any data about the audio recording in any suitable form, and may be entered, generated and/or stored using any suitable technique, as aspects of the present invention are not limited in this respect. Metadata 234 may provide an indication of the word sequence represented by a particular audio recording 232. This indication may be provided in any suitable form, including as a normalized orthography of the word sequence, as a set of orthographic variations of the word sequence, or as a phoneme sequence or other sound sequence corresponding to the word sequence, as aspects of the present invention are not limited in this respect. Metadata 234 may also indicate one or more constraints that may be interpreted by synthesis system 200 to limit or express a preference for the circumstances under which each audio recording 232 or group of audio recordings 232 may be selected and used in providing speech output for speech-enabled application 210. For example, metadata 234 associated with a particular audio recording 232 may constrain that audio recording 232 to be used in providing speech output only for a certain type of speech-enabled application 210, only for a certain type of speech output, and/or only in certain positions within the speech output. Metadata 234 associated with some other audio recordings 232 may indicate that those audio recordings may be used in providing speech output for any matching text, for example in the absence of audio recordings with metadata matching more specific constraints associated with the speech output. Metadata 234 may also indicate information about the voice talent speaker who spoke the associated audio recording 232, such as the speaker's gender, age or name. Further examples of metadata 234 and its use by synthesis system 200 are provided below.

In some embodiments, developer 220 may provide multiple pre-recorded audio recordings 232 as different versions of speech output that can be represented by a same textual orthography. In one example, developer 220 may provide multiple audio recordings for different word versions that can be represented by the same orthography, "20". Such audio recordings may include words pronounced as "twenty", "two zero" and "twentieth". Developer 220 may also provide metadata 234 indicating that the first version is to be used when the orthography "20" appears in the context of a natural number, that the second version is to be used in the context of spelled-out digits, and that the third version is to be used in the context of a date. Developer 220 may also provide other audio recording versions of "twenty" with particular inflections, such as an emphatic version, with associated metadata indicating that they should be used in positions of contrastive stress, or preceding an exclamation mark in a text input. It should be appreciated that the foregoing are merely some examples, and any suitable forms of audio recordings 232 and/or metadata 234 may be used, as aspects of the present invention are not limited in this respect.

In accordance with some embodiments of the present invention, prompt recording dataset 230 may be physically or otherwise integrated with synthesis system 200, and synthesis system 200 may provide an interface through which developer 220 may provide audio recordings 232 and associated metadata 234 to prompt recording dataset 230. In accordance with other embodiments, prompt recording dataset 230 and any associated audio recording input interface may be implemented separately from and independently of synthesis system 200. In some embodiments, speech-enabled application 210 may also be configured to provide an interface through which developer 220 may specify templates for text inputs to be generated by speech-enabled application 210. Such templates may be implemented as text input portions to be accordingly fit together by speech-enabled application 210 in response to certain events. In one example, developer 220 may specify a template including a carrier prompt, "Arriving at _____. Please enjoy your visit." The template may indicate that a content prompt, such as a particular address, should be inserted by the speech-enabled application in the blank in the carrier prompt to generate a text input in response to approaching that address. The interface may be programmed to receive the input templates and integrate them into the program code of speech-enabled application 210. However, it should be appreciated that developer 220 may provide and/or specify audio recordings, metadata and/or text input templates in any suitable way and in any suitable form, with or without the use of one or more specific user interfaces, as aspects of the present invention are not limited in this respect.

During run-time, which may occur after development of speech-enabled application 210 and/or after developer 220 has provided at least some audio recordings 232 that will be used in speech output in a current session, a user 212 may interact with the running speech-enabled application 210. When program code running as part of the speech-enabled application requires the application to output a speech prompt to user 212, speech-enabled application may generate a text input 240 that includes a literal or word-for-word text transcription of the desired speech output. Speech-enabled application 210 may transmit text input 240 (through any suitable communication technique and medium) to synthesis system 200, where it may be processed. In the embodiment of FIG. 2, the input is first processed by front-end component 250. It should be appreciated, however, that synthesis system 200 may be implemented in any suitable form, including forms in which front-end and back-end components are integrated rather than separate, and in which processing steps may be performed in any suitable order by any suitable component or components, as aspects of the present invention are not limited in this respect.

Front-end 250 may process and/or analyze text input 240 to determine the sequence of words and/or sounds represented by the text, as well as any prosodic information that can be inferred from the text. Examples of prosodic information include, but are not limited to, locations of phrase boundaries, prosodic boundary tones, pitch accents, word-, phrase- and sentence-level stress or emphasis, contrastive stress and the like. Numerous techniques exist for such front-end processing, including those used in known TTS systems. Front-end 250 may be implemented in any suitable form using any suitable technique, as aspects of the present invention are not limited in this respect. In some embodiments, front-end 250 may be programmed to process text input 240 to produce a corresponding normalized orthography 252 and a set of markers 254. Front-end 250 may also be programmed to generate a phoneme sequence 256 corresponding to the text input 240, which may be used by synthesis system 200 in selecting one or more matching audio recordings 232 and/or in producing speech output in instances in which a matching audio recording 232 may not be available. Numerous techniques for generating a phoneme sequence are known, and any suitable technique may be used, as aspects of the present invention are not limited in this respect.

Normalized orthography 252 may be a spelling out of the desired speech output represented by text input 240 in a normalized (e.g., standardized) representation that may correspond to multiple textual expressions of the same desired speech output. Thus, a same normalized orthography 252 may be created for multiple text input expressions of the same desired speech output to create a textual form of the desired speech output that can more easily be matched to available audio recordings 232. For example, front-end 250 may be programmed to generate normalized orthography 252 by removing capitalizations from text input 240 and converting misspellings or spelling variations to normalized word spellings specified for synthesis system 200. Front-end 250 may also be programmed to expand abbreviations and acronyms into full words and/or word sequences, and to convert numerals, symbols and other meaningful characters to word forms, using appropriate language-specific rules based on the context in which these items occur in text input 240. Numerous other examples of processing steps that may be incorporated in generating a normalized orthography 252 are possible, as the examples provided above are not exhaustive. Techniques for normalizing text are known, and aspects of the present invention are not limited to any particular normalization technique. Furthermore, while normalizing the orthography may provide the advantages discussed above, not all embodiments are limited to generating a normalized orthography 252.

Markers 254 may be implemented in any suitable form, as aspects of the present invention are not limited in this respect. Markers 254 may indicate in any suitable way the locations of various lexical, syntactic and/or prosodic boundaries and/or events that may be inferred from text input 240. For example, markers 254 may indicate the locations of boundaries between words, as determined through tokenization of text input 240 by front-end 250. Markers 254 may also indicate the locations of the beginnings and endings of sentences and/or phrases (syntactic or prosodic), as determined through analysis of the punctuation and/or syntax of text input 240 by front-end 250, as well as any specific punctuation symbols contributing to the analysis. In addition, markers 254 may indicate the locations of peaks in emphasis or contrastive stress, or various other prosodic patterns, as determined through semantic and/or syntactic analysis of text input 240 by front-end 250. Markers 254 may also indicate the locations of words and/or word sequences of particular text normalization types, such as dates, times, currency, addresses, natural numbers, digit sequences and the like. Numerous other examples of useful markers 254 may be used, as aspects of the present invention are not limited in this respect. Numerous techniques for generating markers are known, and any such techniques or others may be used, as aspects of the present invention are not limited to any particular technique for generating markers.

Markers 254 generated from text input 240 by front-end 250 may be used by synthesis system 200 in further processing to select appropriate audio recordings 232 for rendering text input 240 as speech. For example, markers 254 may indicate the locations of the beginnings and endings of sentences and/or syntactic and/or prosodic phrases within text input 240. In some embodiments, some audio recordings 232 may have associated metadata 234 indicating that they should be selected for portions of a text input at particular positions with respect to sentence and/or phrase boundaries. For example, a comparison of markers 254 with metadata 234 of audio recordings 232 may result in the selection of an audio recording with metadata indicating that it is for phrase-initial use for a portion of text input 240 immediately following a [begin phrase] marker. In addition, markers 254 may indicate the locations of pitch accents and other forms of stress and/or emphasis in text input 240, and markers 254 may be compared with metadata 234 to select audio recordings with appropriate inflections for such locations. However, although markers 254 may be generated by front-end 250 in some embodiments and used in further processing performed by synthesis system 200, it should be appreciated that not all embodiments are limited to generating and/or using markers 254.

Once normalized orthography 252 and markers 254 have been generated from text input 240 by front-end 250, they may serve as inputs to CPR back-end 260. CPR back-end 260 may also have access to audio recordings 232 in prompt recording dataset 230, in any of various ways as discussed above. CPR back-end 260 may be programmed to compare normalized orthography 252 and/or markers 254 to the available audio recordings 232 and their associated metadata to select an ordered set of matching selected audio recordings 262. In some embodiments, CPR back-end 260 may also be programmed to compare the text input 240 itself and/or phoneme sequence 256 to the audio recordings 232 and/or their associated metadata 234 to match the desired speech output to available audio recordings 232. In such embodiments, CPR back-end 260 may use text input 240 and/or phoneme sequence 256 in selecting from audio recordings 232 in addition to or in place of normalized orthography 252 and/or markers 254. As such, it should be appreciated that, although generation and use of normalized orthography 252 and markers 254 may provide the advantages discussed above, in some embodiments any or all of normalized orthography 252, markers 254 and phoneme sequence 256 may not be generated and/or used in selecting audio recordings.

CPR back-end 260 may be programmed to select appropriate audio recordings 232 to match the desired speech output in any suitable way, as aspects of the present invention are not limited in this respect. For example, in some embodiments CPR back-end 260 may be programmed on a first pass to select the audio recording 232 that matches the longest sequence of contiguous words in the normalized orthography 252, provided that the audio recording's metadata constraints are consistent with the normalized orthography 252, markers 254, and/or any annotations received in connection with text input 240. On subsequent passes, if any portions of normalized orthography 252 have not yet been matched with an audio recording 232, CPR back-end 260 may select the audio recording 232 that matches the longest word sequence in the remaining portions of normalized orthography 252, again subject to metadata constraints. Such an embodiment places a priority on having the largest possible individual audio recording used for any as-yet unmatched text, as a larger recording of a voice talent speaking as much of the desired speech output as possible may provide a most natural sounding speech output. However, not all embodiments are limited in this respect, as other techniques for selecting among audio recordings 232 are possible.

In another illustrative embodiment, CPR back-end 260 may be programmed to perform the entire matching operation in a single pass, for example by selecting from a number of candidate sequences of audio recordings 232 by optimizing a cost function. Such a cost function may be of any suitable form and may be implemented in any suitable way, as aspects of the present invention are not limited in this respect. For example, one possible cost function may favor a candidate sequence of audio recordings 232 that maximizes the average length of all audio recordings 232 in the candidate sequence for rendering the speech output. Optimization of such a cost function may place a priority on selecting a sequence with the largest possible audio recordings on average, rather than selecting the largest possible individual audio recording on each pass through the normalized orthography 252. Another example cost function may favor a candidate sequence of audio recordings 232 that minimizes the number of concatenations required to form a speech output from the candidate sequence. It should be appreciated that any suitable cost function, selection algorithm, and/or prioritization goals may be employed, as aspects of the present invention are not limited in this respect.

However matching audio recordings 232 are selected by CPR back-end 260, the result may be a set of one or more selected audio recordings 262, each selected audio recording in the set corresponding to a portion of normalized orthography 252, and thus to a corresponding portion of the text input 240 and the desired speech output represented by text input 240. The set of selected audio recordings 262 may be ordered with respect to the order of the corresponding portions in the normalized orthography 252 and/or text input 240. In some embodiments, for contiguous selected audio recordings 262 from the set that have no intervening unmatched portions in between, CPR back-end 260 may be programmed to perform a concatenation operation to join the selected audio recordings 262 together end-to-end. In other embodiments, CPR back-end 260 may provide the set of selected audio recordings 262 to a different concatenation/streaming component 280 to perform any required concatenations to produce the speech output. Selected audio recordings 262 may be concatenated using any suitable technique (many of which are known in the art), as aspects of the present invention are not limited in this respect.

Figure 1B:
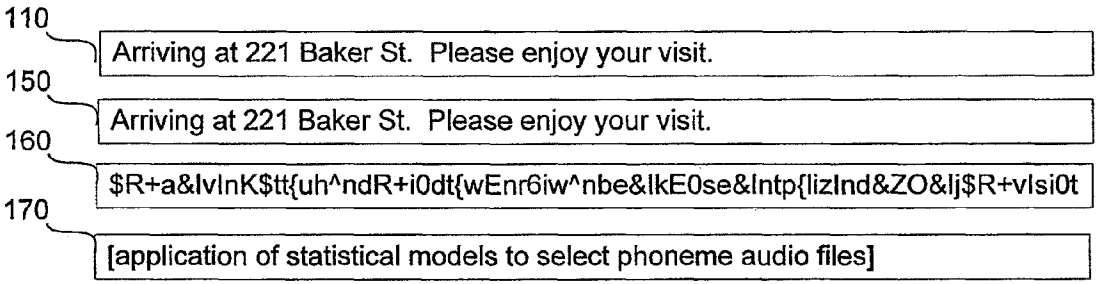
FIG. 1B (Prior Art)
FIG. 1B illustrates an example of conventional text to speech (TTS) synthesis.

If any portion(s) of normalized orthography 252 and/or text input 240 are left unmatched by processing performed by CPR back-end 260 (e.g., if there are one or more portions of normalized orthography 252 for which no matching audio recording 232 is available), synthesis system 200 may in some embodiments be programmed to transmit an error or noncompliance indication to speech-enabled application 210. In other embodiments, synthesis system 200 may be programmed to synthesize those unmatched portions of the speech output using TTS back-end 270. TTS back-end 270 may be implemented in any suitable way. As described above with reference to FIG. 1B, such techniques are known in the art and any suitable technique may be used. TTS back-end 270 may employ, for example, concatenative TTS synthesis, formant TTS synthesis, articulatory TTS synthesis, or any other text to speech synthesis technique as is known in the art or as may later be discovered, as aspects of the present invention are not limited in this respect.

TTS back-end 270 may receive as input phoneme sequence 256 and markers 254. For each portion of phoneme sequence 256 corresponding to a portion of the desired speech output that was not matched to an audio recording 232 by CPR back-end 260, TTS back-end 270 may produce a TTS audio segment 272, in some embodiments using conventional concatenative TTS synthesis techniques. For example, statistical models may be used to select a small audio file from a dataset accessible by TTS back-end 270 for each phoneme in the phoneme sequence for an unmatched portion of the desired speech output. The statistical models may be computed to select an appropriate audio file for each phoneme given the surrounding context of adjacent phonemes given by phoneme sequence 256 and nearby prosodic events and/or boundaries given by markers 254. It should be appreciated, however, that the foregoing is merely an example, and any suitable TTS synthesis technique may be employed by TTS back-end 270, as aspects of the present invention are not limited in this respect.

In some embodiments, a voice talent who recorded generic speech from which phonemes were excised for TTS back-end 270 may also be engaged to record the audio recordings 232 provided by developer 220 in prompt recording dataset 230. In other embodiments, a voice talent may be engaged to record audio recordings 232 who has a similar voice to the voice talent who recorded generic speech for TTS back-end 270 in some respect, such as a similar voice quality, pitch, tambour, accent, speaking rate, spectral attributes, emotional quality, or the like. In this manner, distracting effects due to changes in voice between portions of a desired speech output synthesized using audio recordings 232 and portions synthesized using TTS synthesis may be mitigated.

Selected audio recordings 262 output by CPR back-end 260 and any TTS audio segments 272 produced by TTS back-end 270 may be input to a concatenation/streaming component 280 to produce speech output 290. Speech output 290 may be a concatenation of selected audio recordings 262 and TTS audio segments 272 in an order that corresponds to the desired speech output represented by text input 240. Concatenation/streaming component 280 may produce speech output 290 using any suitable concatenative technique (many of which are known), as aspects of the present invention are not limited in this respect. In some embodiments, such concatenative techniques may involve smoothing processing using any of various suitable techniques as known in the art; however, aspects of the present invention are not limited in this respect.

In some embodiments, concatenation/streaming component 280 may store speech output 290 as a new audio file and provide the audio file to speech-enabled application 210 in any suitable way. In other embodiments, concatenation/streaming component 280 may stream speech output 290 to speech-enabled application 210 concurrently with producing speech output 290, with or without storing data representations of any portion(s) of speech output 290. Concatenation/streaming component 280 of synthesis system 200 may provide speech output 290 to speech-enabled application 210 in any suitable way, as aspects of the present invention are not limited in this respect.

Upon receiving speech output 290 from synthesis system 200, speech-enabled application 210 may play speech output 290 in audible fashion to user 212 as an output speech prompt. Speech-enabled application 210 may cause speech output 290 to be played to user 212 using any suitable technique(s), as aspects of the present invention are not limited in this respect.

Figure 3A:
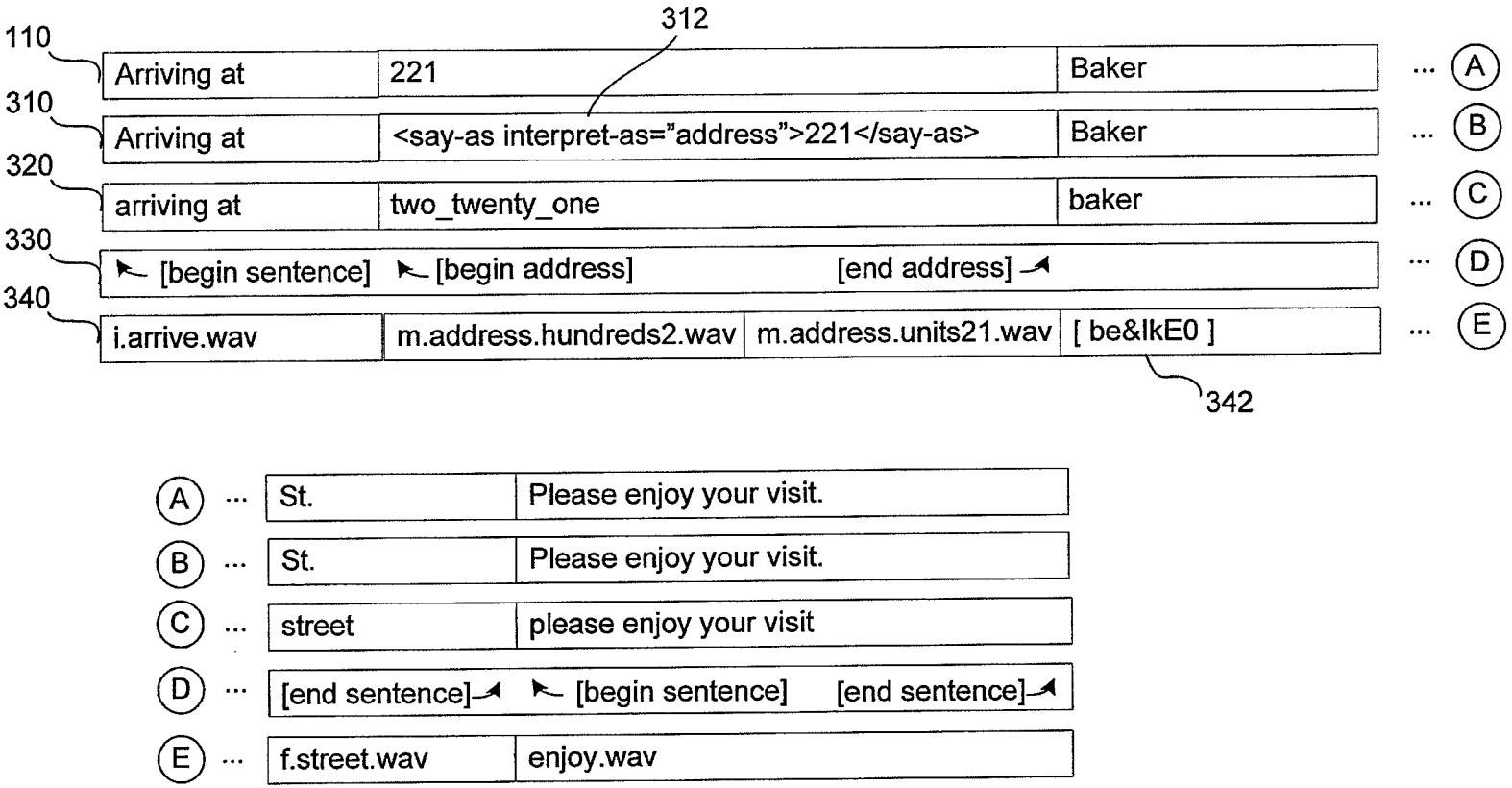
FIGS. 3A and 3B illustrate examples of speech output synthesis in accordance with some embodiments of the present invention.
Figure 3B:
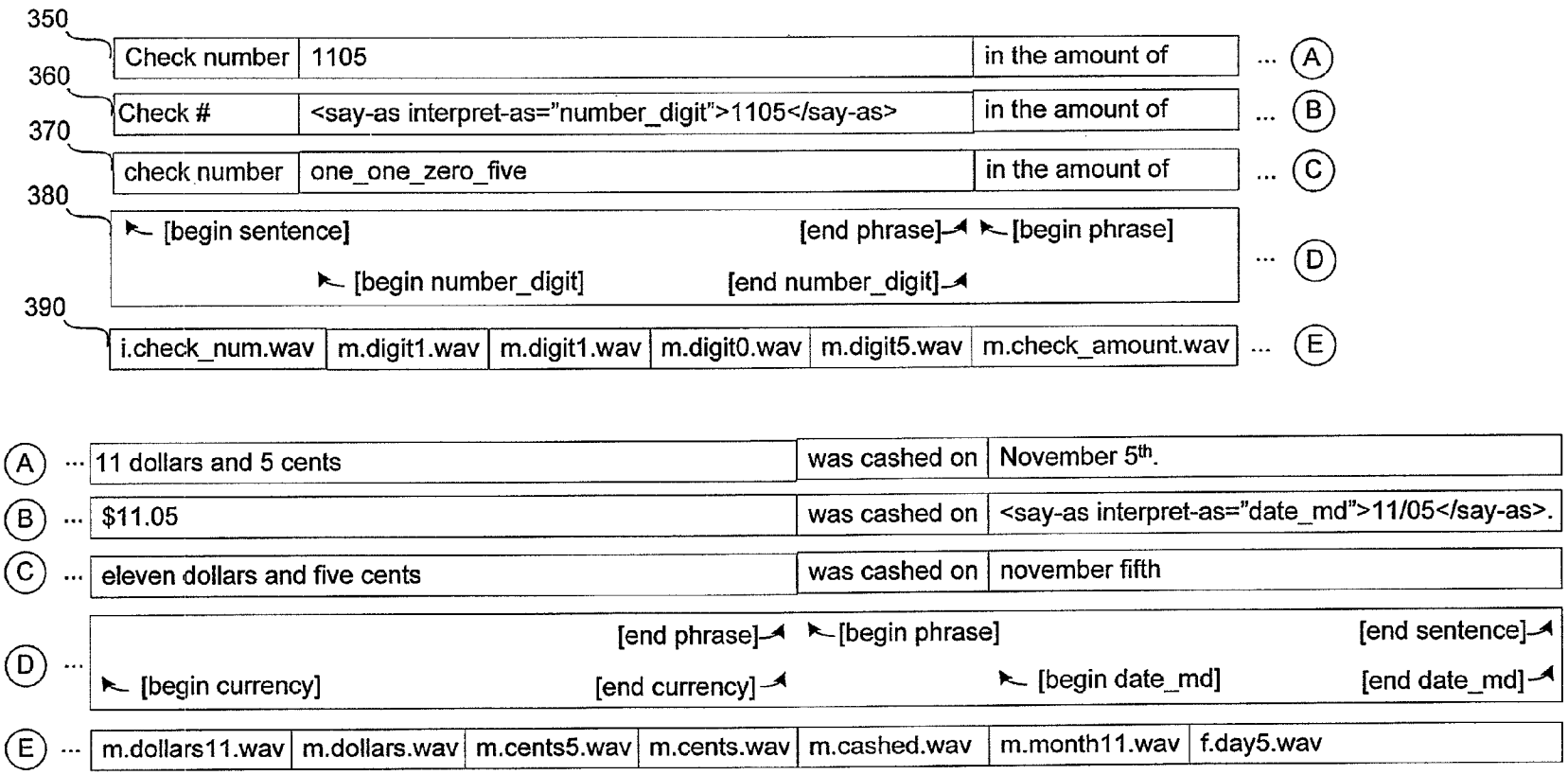

Further description of some functions of a synthesis system (e.g., synthesis system 200) in accordance with some embodiments of the present invention is given with reference to examples illustrated in FIGS. 3A and 3B. FIG. 3A illustrates exemplary processing steps that may be performed by synthesis system 200 in accordance with some embodiments of the present invention to synthesize the desired speech output 110, "Arriving at 221 Baker St. Please enjoy your visit." As shown in FIG. 3A, desired speech output 110 is read across the top line of the top portion of FIG. 3A, continuing at label "A" to the top line of the bottom portion of FIG. 3A. It should be appreciated that desired speech output 110 (i.e., the spoken form of which text input 310 is a text transcription) may not be physically presented in any textual or coded data form to speech-enabled application 210 or synthesis system 200, but is merely shown in FIG. 3A as an abstract representation of an exemplary sentence/word sequence intended to be played as an output speech prompt by speech-enabled application 210. That is, desired speech output 110 may be an abstract word sequence as envisaged by a developer and desired for an output prompt, which may not actually be written down or spelled out prior to the generation of corresponding text input 310 by a speech-enabled application.

Text input 310 is an exemplary text string that speech-enabled application 210 may generate and submit to synthesis system 200, to request that synthesis system 200 provide a synthesized speech output rendering the desired speech output 110 as audio speech. Text input 310 is read across the second line of the top portion of FIG. 3A, continuing at label "B" to the second line of the bottom portion of FIG. 3A. Text input 310 may include a literal, word-for-word, plain text transcription of the desired speech output 110, "Arriving at 221 Baker St. Please enjoy your visit." Speech-enabled application 210 may generate this text input 310 in accordance with the execution of program code supplied by the developer 220, which may direct speech-enabled application 210 to generate a particular text input 310 corresponding to a particular desired speech output 110 in one or more particular circumstances. It should be appreciated that speech-enabled application 210 may be programmed to generate text input 310 for desired speech output 110 in any suitable way, as aspects of the present invention are not limited in this respect.

Accordingly, developer 220 may develop speech-enabled application 210 in part by entering plain text transcription representations of desired speech outputs into the program code of speech-enabled application 210. As shown in FIGS. 3A and 3B, such plain text transcription representations may contain such characters, numerals, and/or other symbols as necessary and/or preferred to transcribe desired speech outputs to text in a literal manner. Synthesis system 200 may be programmed and/or configured to analyze text input 310 and select appropriate audio recordings 232 for use in its synthesis, without requiring the input to specify the filenames of the appropriate audio recordings or any filename mapping function calls hard coded into speech-enabled application 210 and the text input it generates. Synthesis system 200 may select audio recordings 232 from the prompt recording dataset 230 provided by developer 220, and may make selections in accordance with constraints indicated by metadata 234 provided by developer 220. Developer 220 may thus retain a measure of deterministic control over the particular audio recordings used to synthesize any desired speech output, while also enjoying ease of programming, debugging and/or updating speech-enabled application 210 at least in part using plain text. In some embodiments, developer 220 may be free to directly specify a filename for a particular audio recording to be used should an occasion warrant such direct specification; however, developer 220 may be free to also choose plain text representations at any time.

If even finer levels of control are desired, developer 220 may also program speech-enabled application 210 to include with text input 310 one or more annotations, or tags, to constrain the audio recordings 232 that may be used to render various portions of desired speech output 110. For example, text input 310 includes an annotation 312 indicating that the number "221" should be interpreted and rendered in speech as part of an address. In this example, annotation 312 is implemented in the form of a World Wide Web Consortium Speech Synthesis Markup Language (W3C SSML) "say-as" tag, with "address" referred to as the "say-as" type of the number "221" in this desired speech output. SSML tags are an example of a known type of annotation that may be used in accordance with some embodiments of the present invention. However, it should be appreciated that any suitable form of annotation may be employed to indicate a desired type (e.g., a text normalization type) of one or more words in a desired speech output, as aspects of the present invention are not limited in this respect.

Upon receiving text input 310 from speech-enabled application 210, synthesis system 200 may process text input 310 through front-end 250 to generate normalized orthography 320 and markers 330. Normalized orthography 320 is read across the third line of the top portion of FIG. 3A, continuing at label "C" to the third line of the bottom portion of FIG. 3A. Markers 330 are read across the fourth line of the top portion of FIG. 3A, continuing at label "D" to the fourth line of the bottom portion of FIG. 3A. As discussed above with reference to FIG. 2, normalized orthography 320 may represent a conversion of text input 310 to a standard format for use by synthesis system 200 in subsequent processing steps. For example, normalized orthography 320 represents the word sequence of text input 310 with capitalizations, punctuation and annotations removed. In addition, the abbreviation "St." in text input 310 is expanded to the word "street" in normalized orthography 320, and the numerals "221" in text input 310 are converted to the word forms "two_twenty_one" in normalized orthography 320.

In converting the numerals "221" to word forms, synthesis system 200 may make note of annotation 312 and render the numerals in appropriate word forms for an address, in accordance with its programming. Thus, for example, synthesis system 200 may be programmed to convert numerals "221" with "say-as" type "address" to the word form "two_twenty_one" rather than "two_hundred_twenty_one", which might be appropriate for other contexts (e.g., numerals with "say-as" type "currency"). If an annotation is not provided for one or more numerals, words or other character sequences in text input 310, in some embodiments synthesis system 200 may attempt to infer a type of the corresponding words in the desired speech output from the semantic and/or syntactic context in which they occur. For example, in text input 310, the numerals "221" may be inferred to correspond to an address because they are followed by "St." with one intervening word. It should be appreciated that types of words in a desired speech output may be determined using any suitable techniques from any information that may be explicitly provided in text input 310, including associated annotations, or may be inferred from the content of text input 310, as aspects of the present invention are not limited in this respect.

Although certain indications such as capitalization, punctuation and annotations may be removed from normalized orthography 320, syntactic, prosodic and/or word type information represented by such indications may be conveyed through markers 330. For example, markers 330 include [begin sentence] and [end sentence] markers that may be derived from certain capitalizations and punctuation marks in text input 310. In addition, markers 330 include [begin address] and [end address] markers derived from "say-as" tag 312. Although not shown in FIG. 3A, markers 330 may also include markers indicating the locations of boundaries between words, which may be useful in generating normalized orthography 320 (e.g., with correctly delineated words), selecting audio recordings (e.g., from input text 310, normalized orthography 320 and/or a generated phoneme sequence with correctly delineated words), and/or generating any appropriate TTS audio segments, as discussed above. In addition, markers 330 may indicate the locations of prosodic boundaries and/or events, such as locations of phrase boundaries, prosodic boundary tones, pitch accents, word-, phrase- and sentence-level stress or emphasis, contrastive stress and the like. The locations and labels for such markers may be determined, for example, from punctuation marks, annotations, syntactic sentence structure and/or semantic analysis. Techniques exist for determining markers of the above-mentioned types. It should be appreciated that markers 330 may be determined using any suitable techniques and implemented in any suitable way, as aspects of the present invention are not limited in this respect.

Audio segments 340 are read across the bottom line of the top portion of FIG. 3A, continuing at label "E" to the bottom line of the bottom portion of FIG. 3A. When selecting one or more audio segments 340 to produce a speech output corresponding to desired speech output 110, synthesis system 200 may make use of any of various forms of information and/or constraints indicated by text input 310, normalized orthography 320 and/or markers 330. For example, synthesis system 200, through CPR back-end 260, may select an audio recording with filename "i.arrive.wav" for the beginning portion of desired speech output 110, if metadata associated with the audio recording indicate that it matches a normalized orthography of "arriving at". CPR back-end 260 may select the audio recording "i.arrive.wav" rather than the audio recording "m.arrive.wav" matching the same normalized orthography, if the metadata associated with "i.arrive.wav" indicate that it should be used in sentence-initial position and the metadata associated with "m.arrive.wav" indicate that it should be used in sentence-medial position. For example, developer 220 may have provided multiple audio recordings for a normalized orthography of "arriving at", including audio recordings "i.arrive.wav" and "m.arrive.wav", in part to include speech utterances including the same words that are produced differently at different positions within a sentence and/or phrase.

Similarly, CPR back-end 260 may select "f.street.wav" as an audio recording whose metadata indicate that it matches a normalized orthography of "street" in sentence-final position. Thus, CPR back-end 260 may compare normalized orthography 320 and syntactic/prosodic boundary conditions indicated by markers 330 with the metadata constraints of audio recordings 232 to select matching audio recordings for the desired speech output 110. Such metadata constraints may be independent of the filenames assigned to audio recordings 232. While FIG. 3A illustrates a particular example of a filename and file format convention, it should be appreciated that the filenames and file formats of audio recordings 232 may be specified in any suitable way or form, including forms that convey no information about the word content or sentence position of the audio recordings 232, as aspects of the present invention are not limited in this respect. For example, CPR back-end may alternatively select an audio recording named "random_name.ulaw" for the word "street", provided that its metadata constraints match characteristics of that portion of the desired speech output 110.

CPR back-end 260 may also make use of any information provided through text input 310, including annotations such as annotation 312, when selecting audio recordings for synthesis. For example, when matching the "two_twenty-_one" portion of the normalized orthography 320, CPR back-end 260 may select audio recordings whose metadata indicate that they are for use in synthesizing portions of text input with a "say-as" type of "address". Speech-enabled application 210 may also be programmed to provide other types of annotations along with text input 310 that may be used in selecting audio recordings for synthesis. For example, annotations from speech-enabled application 210 may indicate that the application is used in a particular domain, such as banking, e-mail, driving directions or any of numerous others, or that the application should output speech in a particular language and/or dialect. Such annotations may, for example, allow CPR back-end 260 to select among multiple audio recordings for the same orthography, as a same word or word sequence may be pronounced differently, or with different inflections, in different domains and/or languages or dialects. Alternatively or additionally, synthesis system 200 may infer such constraints from the content of text input 310 using any suitable technique(s). Speech-enabled application 210 may also provide an indication of a preferred speaker parameter for the speech output, such as a gender or age of a voice talent represented in prompt recording dataset 230. Prompt recording dataset 230 may contain audio recordings 232 spoken by different voice talent speakers, and speech-enabled application 210 may even request a particular name of a desired speaker (i.e., a particular speaker identity) for desired speech output 110. Any suitable constraints, such as the examples provided above, may be referenced by the synthesis system 200 and compared with metadata 234 of audio recordings 232 when selecting matching audio recordings for synthesis through CPR back-end 260.

As discussed above, in some embodiments CPR back-end 260 may attempt to match the longest appropriate sequences of words and/or characters in normalized orthography 320 to single audio recordings. This may reduce the number of concatenations required to produce the resulting speech output, thereby reducing processing and also increasing the naturalness of the resulting speech output. However, in some embodiments, the goal of matching longer word sequences may be outranked by one or more applicable metadata constraints. For instance, in the example of FIG. 3A, an audio recording may be available that corresponds to the normalized orthography "street please enjoy your visit". However, CPR back-end 260 may not select that longer audio recording if its associated metadata indicate that it should not be used across a sentence boundary. Such metadata would conflict with the markers 330 indicating that one sentence ends and another begins between "street" and "please". CPR back-end 260 may therefore render that portion of desired speech output 110 as two separate audio recordings, representing the longest matches with no conflicting metadata constraints.

As discussed above, some portions of text input 310 and/or normalized orthography 320 may not have an appropriate match among the available audio recordings 232. For example, the word "Baker" in desired speech output 110 may not have been pre-recorded by a voice talent. In some embodiments, synthesis system 200 may synthesize such unmatched portions of text input 310 in any suitable manner, e.g., using TTS back-end 270. For example, the word "Baker" may be represented as a phoneme sequence 342 and synthesized using any suitable TTS synthesis technique, examples of which are described above. In the example shown in FIG. 3A, phoneme sequence 342 is specified in the L&H+ phonetic alphabet; however, it should be appreciated that any phoneme sequence, such as example phoneme sequence 342, may be specified in any suitable form during processing of a text input, as aspects of the present invention are not limited in this respect. In other embodiments, synthesis system 200 may not produce any speech output for text inputs with one or more portions unmatched to any audio recording 232, but may instead transmit an error message to speech-enabled application 210 in such situations. It should be appreciated that synthesis system 200 may respond to lack of matching audio recordings 232 for one or more portions of text input 310 in any suitable way, as aspects of the present invention are not limited in this respect.

When all audio segments 340 to synthesize the entire text input 310 have been selected and/or generated, including selected audio recordings and any additional audio segments produced using TTS synthesis, synthesis system 200 may concatenate the sequence of audio segments 340 and provide the resulting speech output to speech-enabled application 210 as discussed above. As discussed above, synthesis system 200 may generate the resulting speech output using any suitable concatenation technique, as aspects of the present invention are not limited in this respect.

FIG. 3B illustrates another example in which CPR back-end 260 of synthesis system 200 may select audio recordings for concatenation to produce a speech output in accordance with metadata constraints. In this example, the desired speech output 350 is the sentence, "Check number 1105 in the amount of 11 dollars and 5 cents was cashed on November 5$^{th}$." Example desired speech output 350 may be intended, for example, as an output speech prompt in an IVR dialog for a banking call center. As shown in FIG. 3B, desired speech output 350 is read across the top line of the top portion of FIG. 3B, continuing at label "A" to the top line of the bottom portion of FIG. 3B. Similarly, text input 360, normalized orthography 370, markers 380 and audio recordings 390 are read across the respective lines of the top portion of FIG. 3B, continuing at the respective labels to the respective lines of the bottom portion of FIG. 3B. In a similar process as described above with reference to FIG. 3A, speech-enabled application 210 may generate text input 360 as an annotated plain text transcription of desired speech output 350.

Upon receiving text input 360, synthesis system 200 may, e.g., through front-end 250, generate a normalized orthography 370 corresponding to text input 360. As described above, normalized orthography 370 may represent an orthographic standardization of text input 360. In the illustrative orthographic representation in FIG. 3B, capitalization, punctuation and annotations are removed, and numerals and other symbols (e.g., "#" and "$") are spelled out in appropriate word forms. It should be appreciated that normalized orthography 370, as illustrated in FIG. 3B, is merely one example, as any suitable standardized orthography may be used. In addition, in some embodiments a normalized orthography may not be necessary, and a text input as received from a speech-enabled application may be sufficient for comparison to available audio recordings and associated metadata for synthesis of a speech output.

Front-end 250 may also generate a set of markers 380, including markers for sentence and phrase boundaries and markers for regions of specific text normalization types. By comparing the text input 360, normalized orthography 370 and markers 380 to the available audio recordings 232 and associated metadata 234 in prompt recording dataset 230 provided by developer 220, CPR back-end 260 of synthesis system 200 may select matching audio recordings 390 corresponding to the various portions of text input 360. If applicable, TTS back-end 270 may be used to generate additional audio segments for any portions of text input 360 that are not matched by audio recordings. Synthesis system 200 may then, through concatenation/streaming component 280, concatenate the selected audio recordings 390 and provide the resulting speech output for speech-enabled application 210 in any of the ways discussed above.

In the example text input 360, the sequence of numerals 1-1-0-5 appears as a different word type (e.g., text normalization type) in each of three instances. For each instance, synthesis system 200 may use annotations supplied with text input 360 and/or syntactic or semantic context to determine appropriate normalized orthography and to match the numeral sequence to appropriate metadata constraints associated with audio recordings 232. For example, text input 360 includes annotations specifying a "say-as" type for both check number "1105" and date "11/05", which may be compared with metadata constraining the word types for which various audio recordings should be used. Alternatively, in some embodiments such word types may be inferred from context; for example, a numeral sequence following the words "check number" may be likely to be interpreted as a sequence of digits. The annotated and/or inferred word types may be directly communicated to CPR back-end 260 through appropriate markers 380, which may be compared against the metadata 234 of audio recordings 232. Examples of such markers include the [begin number_digit], [end number_digit], [begin date_md] and [end date_md] of markers 380.

Some word types in a text input may also be inferred from the content and/or syntax of those words themselves, without reference to annotations or to surrounding context. For example, the symbols and syntax used in "$11.05" in example text input 360 may be sufficient to indicate to synthesis system 200 that the corresponding normalized orthography and audio recordings should be selected as appropriate for communicating amounts of currency. This determination may be reflected in the generation of appropriate [begin currency] and [end currency] markers 380 for the corresponding portion of text. Syntactic and/or semantic structure in text input 360 may also provide an indication of prosodic boundary locations, such as the locations of sentence-internal phrase boundaries indicated by markers 380. As discussed above, markers 380 indicating prosodic and/or syntactic boundaries may be compared with metadata associated with available audio recordings to select audio recordings whose metadata indicate that they should be used in particular locations with respect to such prosodic and/or syntactic boundaries.

In other examples, synthesis system 200 may perform semantic analysis of a text input to infer prosodic constraints to match against metadata of available audio recordings, such as pitch inflections, stress or emphasis patterns, character and tone. In some instances, semantic analysis may reveal an indication of a particular emphasis pattern that should be matched in selection of audio recordings to synthesize the desired speech output. For example, a text input of, "Flight number 1353, originally scheduled to depart at 12:20, will now depart at 12:40," may indicate a contrastive stress pattern in which the word "forty" should be particularly emphasized in contrastive stress with the word "twenty". In selecting an audio recording from multiple different recordings of the word "forty", CPR back-end 260 may preferentially select an audio recording whose metadata indicates a match with that particular pattern of contrastive stress. Semantic analysis may also provide an indication of a particular emotional character or tone to be matched in synthesis. For example, text input containing specific phrases such as "I'm sorry" may be matched with audio recordings whose metadata indicate a regretful emotional character.

It should be appreciated that synthesis system 200 may determine and/or infer constraints of any suitable form from text input using any suitable techniques, as aspects of the present invention are not limited to the examples discussed above nor in any other respect. Similarly, it should be appreciated that developer 220 may supply metadata 234 indicating any number of constraints of any suitable form in any suitable way for constraining the selection of various audio recordings 232 by synthesis system 200, as aspects of the present invention are not limited in this respect. Although specific examples of applicable constraints have been provided with reference to the figures above, it should be appreciated that aspects of the present invention are not limited to the specific examples provided herein, and that any other desired types of constraints and constraint types can be used.

Figure 4:
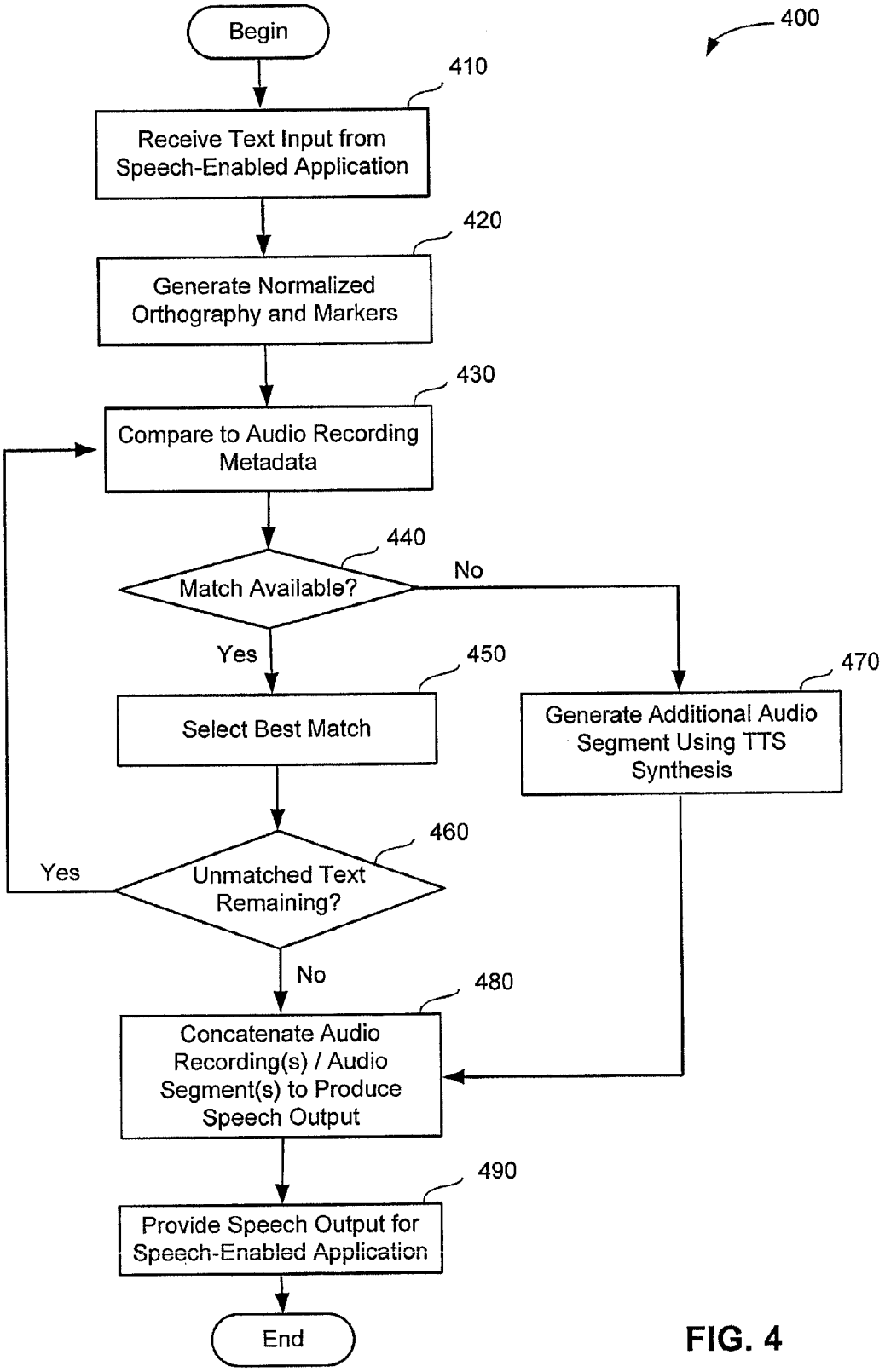
FIG. 4 is a flow chart illustrating an exemplary method for providing speech output for a speech-enabled application, in accordance with some embodiments of the present invention.

FIG. 4 illustrates an exemplary method 400 for use by synthesis system 200 or any other suitable system for providing speech output for a speech-enabled application in accordance with some embodiments of the present invention. Method 400 begins at act 410, at which text input may be received from a speech-enabled application. At act 420, a normalized orthography and one or more markers corresponding to the text input may be generated. As discussed above, the normalized orthography may represent a standardized spelling out of the words included in the text input, and the markers may indicate the locations of various syntactic and prosodic boundaries and/or events within the text input.

At act 430, the text input, normalized orthography and/or markers may be compared with metadata associated with one or more available audio recordings provided by a developer of the speech-enabled application. As discussed above, the available audio recordings may be specified by the developer and pre-recorded by a voice talent in connection with development of the speech-enabled application. The content of the audio recordings may be specified by the developer as appropriate for the intended output speech prompts of the speech-enabled application. The developer may also provide associated metadata indicating one or more constraints regarding the selection and use of particular audio recordings by the synthesis system.

As discussed above, metadata provided by the developer in association with an audio recording may indicate a normalized orthography of a word or word sequence spoken by the voice talent in creating the audio recording. In some embodiments, metadata may also indicate one or more text input sequences and/or one or more generated phoneme sequences to which an audio recording is constrained to be matched. Other examples of metadata that may be provided by the developer in association with an audio recording include, but are not limited to, information regarding a language represented by the audio recording, information regarding the identity of the voice talent speaker who spoke the audio recording, information regarding the gender of the voice talent speaker, an indication of a speech-enabled application domain to which the audio recording is constrained to be matched, an indication of an output word type (e.g., a text normalization type) to which the audio recording is constrained to be matched, an indication of a phonemic context to which the audio recording is constrained to be matched, an indication of a punctuation boundary in a text input to which the audio recording is constrained to be matched, an indication of a sentence and/or phrase position to which the audio recording is constrained to be matched, an indication of an emotional category to which the audio recording is constrained to be matched, and an indication of a contrastive stress pattern to which the audio recording is constrained to be matched. As discussed above, it should be appreciated that any suitable form of metadata indicating any suitable information and/or constraints may be provided by a developer in association with audio recordings, as aspects of the present invention are not limited in this respect.

At act 440, a determination may be made based on the comparison at act 430 as to whether an audio recording is available whose metadata information and/or constraints match the information and/or constraints determined and/or inferred from the text input, normalized orthography and/or markers for any portion of the text input, without conflicting constraints. If no audio recording is available whose metadata information and/or constraints match all of the information and/or constraints of a portion of the text input, one or more matches may be identified as audio recordings whose metadata information and/or constraints match some subset of the information and/or constraints of that portion of the text input, without conflicting constraints. If the determination at act 440 is that a match is available, method 400 may proceed to act 450, at which one or more best matches may be selected.

As discussed above, best matches between available audio recordings and portions of the text input may be selected in various ways, subject to the constraints indicated by the audio recording metadata. In some embodiments, audio recordings may be matched to the text input in an iterative fashion; in each iteration, the longest audio recording with matching metadata constraints may be selected as the best match for each as-yet unmatched portion of the text input. In other embodiments, audio recordings may be matched to the text input in one pass, for example through optimizing a cost function with respect to the average length of all audio recordings selected or the number of required concatenations while satisfying metadata constraints. As discussed above, these are merely examples, as aspects of the present invention are not limited to any particular matching or selection technique.

In some embodiments, an audio recording with a greater number of metadata constraints may be considered a better match than an audio recording with fewer metadata constraints, provided the constraints are matched by the relevant parameters of the text input. In some embodiments, metadata constraints may be classified such that compliance with some may be required while compliance with others may merely be preferred. In some embodiments, one or more metadata constraints may be overridden by metadata indicating that a particular audio recording should be selected despite the possible availability of another audio recording that is a better match. Such metadata may allow a developer of a speech-enabled application to give preference to using certain audio recordings or groups of audio recordings as desired, such as recently created audio recordings or audio recordings of a preferred voice talent. In some embodiments, one or more metadata constraints may be overridden by metadata indicating that a particular audio recording should not be selected even if it is a match. Such metadata may allow the developer to selectively disable some audio recordings or groups of audio recordings as desired while one or more speech-enabled applications are running and/or being developed. In some embodiments, when two or more audio recordings are equally matched to a portion of the text input based on length and metadata constraints, the tie may be broken in any suitable fashion, such as by selecting the audio recording most recently provided by the developer or in any other way. It should be appreciated that the above-described ways of determining best matches between text input and available audio recordings in accordance with metadata constraints are merely examples, and such matches may be selected in any suitable way, as aspects of the present invention are not limited in this respect.

At act 460, once one or more best matches have been selected, a determination may be made as to whether any portion of the text input remains for which a matching audio recording has not yet been selected. If the determination is that unmatched text remains, method 400 may loop back to act 430, at which the remaining portion(s) of the text input, normalized orthography and/or markers may again be compared to the metadata of available audio recordings in search for a match. In embodiments in which best matches are selected in an iterative fashion, this loop may represent a subsequent iteration of the best match selection process.

If at any iteration it is determined at act 440 that no matching audio recording is available for any remaining unmatched portion(s) of the text input, method 400 may proceed to act 470, at which additional audio segment(s) for the unmatched portion(s) of the text input may be generated using TTS synthesis. As discussed above, any suitable TTS technique may be employed, including, but not limited to, concatenative TTS synthesis, formant synthesis and articulatory synthesis, as aspects of the present invention are not limited in this respect. In some embodiments, additional audio segment(s) for unmatched portion(s) of the text input may be selected from a library of "tuned TTS" segments. Such tuned TTS segments may previously have been generated using any of the above-mentioned TTS synthesis techniques, then tuned or sculpted to achieve a desired output pronunciation, and stored as a set of parameters and/or as an audio file for later use in concatenation for speech synthesis. Such tuning or sculpting may be performed using any suitable technique, such as that described in U.S. patent application Ser. No. 10/417,347, entitled "Method and Apparatus for Sculpting Synthesized Speech", which is incorporated by reference herein in its entirety. It should be appreciated that the foregoing are merely examples, and aspects of the present invention are not limited to the use of any particular TTS synthesis technique.

In some embodiments, if a library of different voices is available for the TTS synthesis, a voice may be selected that sounds similar to the voice of the speaker who spoke the audio recordings provided by the developer of the speech-enabled application. In other embodiments, the same voice talent may be engaged to create the library of phoneme recordings accessed by the TTS synthesis component as well as the developer-supplied audio recordings of the prompt recording database, such that the voice need not change between concatenated audio recordings and TTS audio segments. However, it should be appreciated that aspects of the present invention are not limited to any particular selection of voice talent, and any suitable voice talent(s) may be used in creating audio recordings, with or without any connection or similarity to the voice talent(s) used in any TTS synthesis system component.

After generating additional audio segments for all unmatched portions of the text input, method 400 may proceed to act 480. Method 400 may also arrive at act 480 from act 460, if at some iteration all portions of the text input are matched with selected audio recordings, and a determination is made at act 460 that no unmatched text remains. At act 480, any audio recording(s) selected in the various iterations of act 450 and any additional audio segment(s) generated at act 470 may be concatenated to produce a speech output. Method 400 may then end at act 490, at which the speech output thus produced may be provided for the speech-enabled application.

Figure 5:
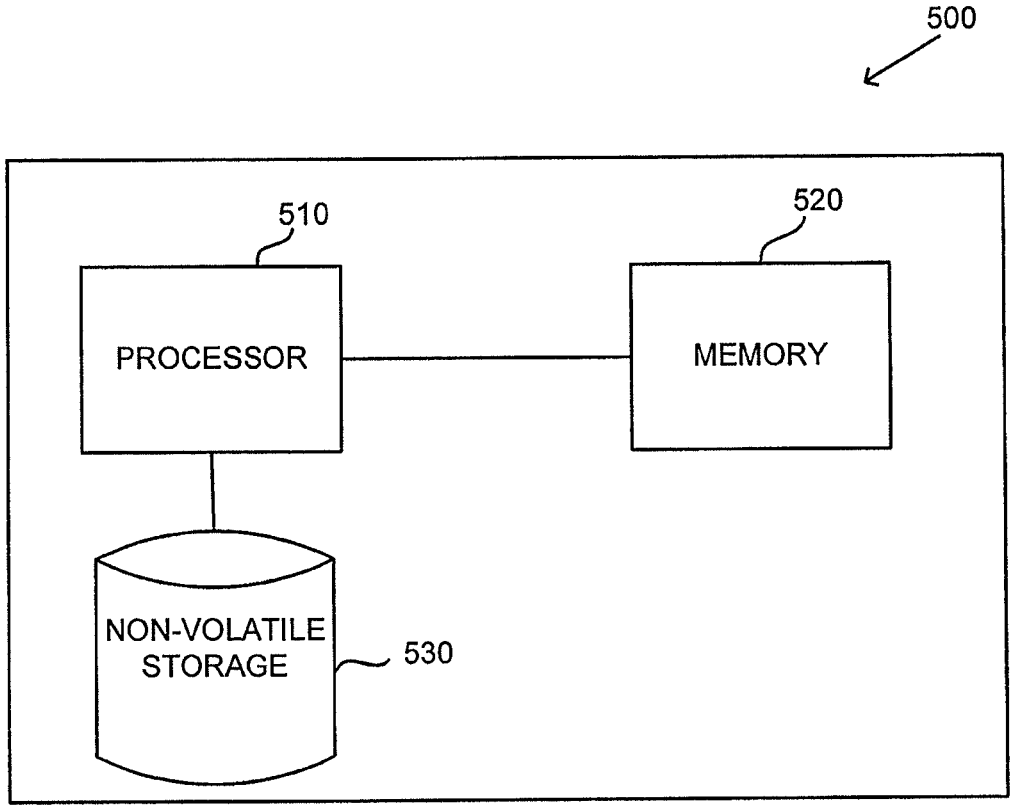
FIG. 5 is a block diagram of an exemplary computer system on which aspects of the present invention may be implemented.

A synthesis system for providing speech output for a speech-enabled application in accordance the techniques described herein may take any suitable form, as aspects of the present invention are not limited in this respect. An illustrative implementation using a computer system 500 that may be used in connection with some embodiments of the present invention is shown in FIG. 5. The computer system 500 may include one or more processors 510 and computer-readable storage media (e.g., memory 520 and one or more non-volatile storage media 530, which may be formed of any suitable non-volatile data storage media). The processor 510 may control writing data to and reading data from the memory 520 and the non-volatile storage device 530 in any suitable manner, as the aspects of the present invention described herein are not limited in this respect. To perform any of the functionality described herein, the processor 510 may execute one or more instructions stored in one or more computer-readable storage media (e.g., the memory 520), which may serve as non-transitory computer-readable storage media storing instructions for execution by the processor 510.

The above-described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. It should be appreciated that any component or collection of components that perform the functions described above can be generically considered as one or more controllers that control the above-discussed functions. The one or more controllers can be implemented in numerous ways, such as with dedicated hardware, or with general purpose hardware (e.g., one or more processor's) that is programmed using microcode or software to perform the functions recited above.

In this respect, it should be appreciated that one implementation of the embodiments of the present invention comprises at least one non-transitory computer-readable storage medium (e.g., a computer memory, a floppy disk, a compact disk, a tape, etc.) encoded with a computer program (i.e., a plurality of instructions), which, when executed on a processor, performs the above-discussed functions of the embodiments of the present invention. The computer-readable storage medium can be transportable such that the program stored thereon can be loaded onto any computer resource to implement the aspects of the present invention discussed herein. In addition, it should be appreciated that the reference to a computer program which, when executed, performs the above-discussed functions, is not limited to an application program running on a host computer. Rather, the term computer program is used herein in a generic sense to reference any type of computer code (e.g., software or microcode) that can be employed to program a processor to implement the above-discussed aspects of the present invention.

Various aspects of the present invention may be used alone, in combination, or in a variety of arrangements not specifically discussed in the embodiments described in the foregoing and are therefore not limited in their application to the details and arrangement of components set forth in the foregoing description or illustrated in the drawings. For example, aspects described in one embodiment may be combined in any manner with aspects described in other embodiments.

Also, embodiments of the invention may be implemented as one or more methods, of which an example has been provided. The acts performed as part of the method(s) may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed. Such terms are used merely as labels to distinguish one claim element having a certain name from another element having a same name (but for use of the ordinal term).

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the invention in detail, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

What is claimed is:

1. A method for providing a speech output for a speech-enabled application, the method comprising:

receiving from the speech-enabled application a text input comprising a text transcription of a desired speech output;

selecting, using at least one computer system, a sequence of audio recordings for concatenation to produce the desired speech output, the selected sequence of audio recordings comprising a first audio recording for concatenation with one or more other audio recordings in the selected sequence of audio recordings, the first audio recording selected for being of a speaker speaking a plurality of words in the text transcription, wherein selecting the sequence of audio recordings comprises applying one or more selection criteria that favor the selected sequence of audio recordings for being a smaller number of audio recordings than other candidate sequences of audio recordings for producing the desired speech output;

generating a speech output by concatenating the selected sequence of audio recordings; and providing the generated speech output for the speech-enabled application.

2. The method of claim 1, wherein the first audio recording is of the speaker reading at least a portion of a script, the at least a portion of the script corresponding exactly to the plurality of words, the plurality of words corresponding exactly to words of the text transcription.

3. The method of claim 1, wherein the first audio recording is stored in a single audio file.

4. The method of claim 1, wherein the plurality of words were spoken consecutively by the speaker when forming the first audio recording.

5. The method of claim 1, wherein the first audio recording comprises the plurality of words spoken naturally by the speaker.

6. The method of claim 1, wherein applying the one or more selection criteria to select the sequence of audio recordings comprises identifying the plurality of words matched by the first audio recording as being a longer sequence of contiguous words in the text transcription than a second plurality of words matched by a second audio recording in another candidate sequence of audio recordings for producing the desired speech output.

7. The method of claim 1, wherein applying the one or more selection criteria to select the sequence of audio recordings comprises optimizing a cost function maximizing an average length of audio recordings in the sequence of audio recordings for concatenation.

8. The method of claim 1, wherein applying the one or more selection criteria to select the sequence of audio recordings comprises optimizing a cost function minimizing a number of concatenations between audio recordings in the sequence of audio recordings.

9. A method for providing a speech output for a speech-enabled application, the method comprising:

receiving at least one input specifying a desired speech output;

selecting, using at least one computer system, at least one audio recording corresponding to at least a first portion of the desired speech output, the selecting comprising:

in response to identifying a desired contrastive stress pattern in the desired speech output, selecting the at least one audio recording based at least in part on metadata, belonging to the at least one audio recording, that identifies the at least one audio recording as carrying contrastive stress; and providing for the speech-enabled application a speech output comprising the at least one audio recording.

10. At least one non-transitory computer-readable storage medium encoded with a plurality of computer-executable instructions that, when executed, perform a method for providing a speech output for a speech-enabled application, the method comprising:

receiving at least one input specifying a desired speech output;

selecting at least one audio recording corresponding to at least a first portion of the desired speech output, the selecting comprising:

in response to identifying a desired contrastive stress pattern in the desired speech output, selecting the at least one audio recording based at least in part on metadata, belonging to the at least one audio recording, that identifies the at least one audio recording as carrying contrastive stress; and providing for the speech-enabled application a speech output comprising the at least one audio recording.

* * * * *